US006209378B1

(12) United States Patent
Bradshaw

(10) Patent No.: US 6,209,378 B1
(45) Date of Patent: Apr. 3, 2001

(54) ADJUSTABLE MONITORING GUIDE

(75) Inventor: Timothy J. Bradshaw, North Grafton, MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 09/563,996

(22) Filed: May 3, 2000

Related U.S. Application Data

(60) Provisional application No. 60/132,242, filed on May 3, 1999.

(51) Int. Cl.[7] ..... B21B 39/20
(52) U.S. Cl. ..... 72/250
(58) Field of Search ..... 72/250, 251, 252, 72/419, 420, 428, 426

(56) References Cited

U.S. PATENT DOCUMENTS

| | | | | |
|---|---|---|---|---|
| 4,680,953 | * | 7/1987 | Fabris | 72/250 |
| 4,790,164 | | 12/1988 | Rothe . | |
| 5,937,689 | * | 8/1999 | Fabris | 72/250 |
| 6,018,974 | * | 2/2000 | Potthoff et al. | 72/250 |

FOREIGN PATENT DOCUMENTS

| | | |
|---|---|---|
| 0740967A1 | 4/1996 | (EP) . |
| 2104814 | 3/1983 | (GB) . |

* cited by examiner

*Primary Examiner*—Rodney A. Butler
(74) *Attorney, Agent, or Firm*—Samuel, Gauthier & Stevens

(57) ABSTRACT

A roller guide assembly is disclosed for guiding a workpiece into a roll pass of a rolling mill. The guide assembly comprises: a rigid housing structure; a pair of roller holders extending lengthwise of the housing structure on opposite sides of the intended direction of travel of the workpiece; guide rollers rotatably carried on the roller holders, the guide rollers defining a gap therebetween and being configured to engage and guide the workpiece into the roll pass of the rolling mill; pivots for mounting the roller holders on the housing structure for movement about axes extending generally parallel to the rotational axes of the guide rollers; springs for applying forces to the roller holders to rotate the roller holders about their respective axes in directions urging the guide rollers apart; and stops on the housing structure for resisting rotation of the roller holders, at least one of the stops acting through a force sensor to provide a measure of the force being applied to the respective roller holder.

4 Claims, 4 Drawing Sheets

ADJUSTABLE MONITORING GUIDE

RELATED APPLICATIONS

This application claims priority from Provisional Patent Application Ser. No. 60/132,242 filed May 3, 1999.

BACKGROUND

1. Field of the Invention

This invention relates to roller guides of the type employed in rolling mills to guide rod and bar products into roll passes.

2. Description of the Prior Art

In the rolling of steel rods and bars, significant operational benefits can be realized by employing so-called "reducing-sizing mills" ("RSM") of the type disclosed in U.S. Pat. No. 5,325,697 issued Jul. 5, 1994 to Shore et al., the description of which is herein incorporated by reference in its entirety. Advantages of rolling with such mills include improved dimensional control of the finished product, higher mill utilization and increased free sizing capability.

FIG. 1 illustrates a typical pass progression of the reducing-sizing process, which begins with a leading oval 10 followed by three round passes, 12, 14 and 16. Relatively small changes in the finished round bar or rod can be made by changing the roll partings on the last three round passes. Alternatively, the feed section, which is typically round, can be changed slightly, but this entails adjusting upstream mill equipment, resulting in a non round feed section, which can impose other process limitations.

There has been a reluctance on the part of those skilled in the art to undertake any parting changes to the oval pass 10, owing to problems associated with adjusting downstream roller entry guides to exactly match the resulting modified oval. Previous technology roller guides do not have the capability to be precisely adjusted whilst located on the mill and an offline alignment station is usually used for this, which obviously requires removal of the guide from the mill and therefore a mill stoppage.

Feeding an oversized section through a roller entry guide is not desirable since this drastically reduces the life of the bearings within the guide rollers and can lead to some further processing problems. If the oval section is adjusted to be smaller than the guide setting, a severe oscillation of the rolled product manifests within the guide, causing severe processing problems and poor quality finished product.

An objective of the present invention is to provide a roller guide assembly which can be precisely adjusted on line to accommodate different sized process sections, thus making it possible for example to change the parting of the oval pass 10, which in turn beneficially increases the free sizing capability of the mill.

Additional objectives and advantages will become evident as the description proceeds with reference to the accompanying drawings, wherein:

DETAILED DESCRIPTION OF THE PREFERRED EMBODIMENT

Figure 2:
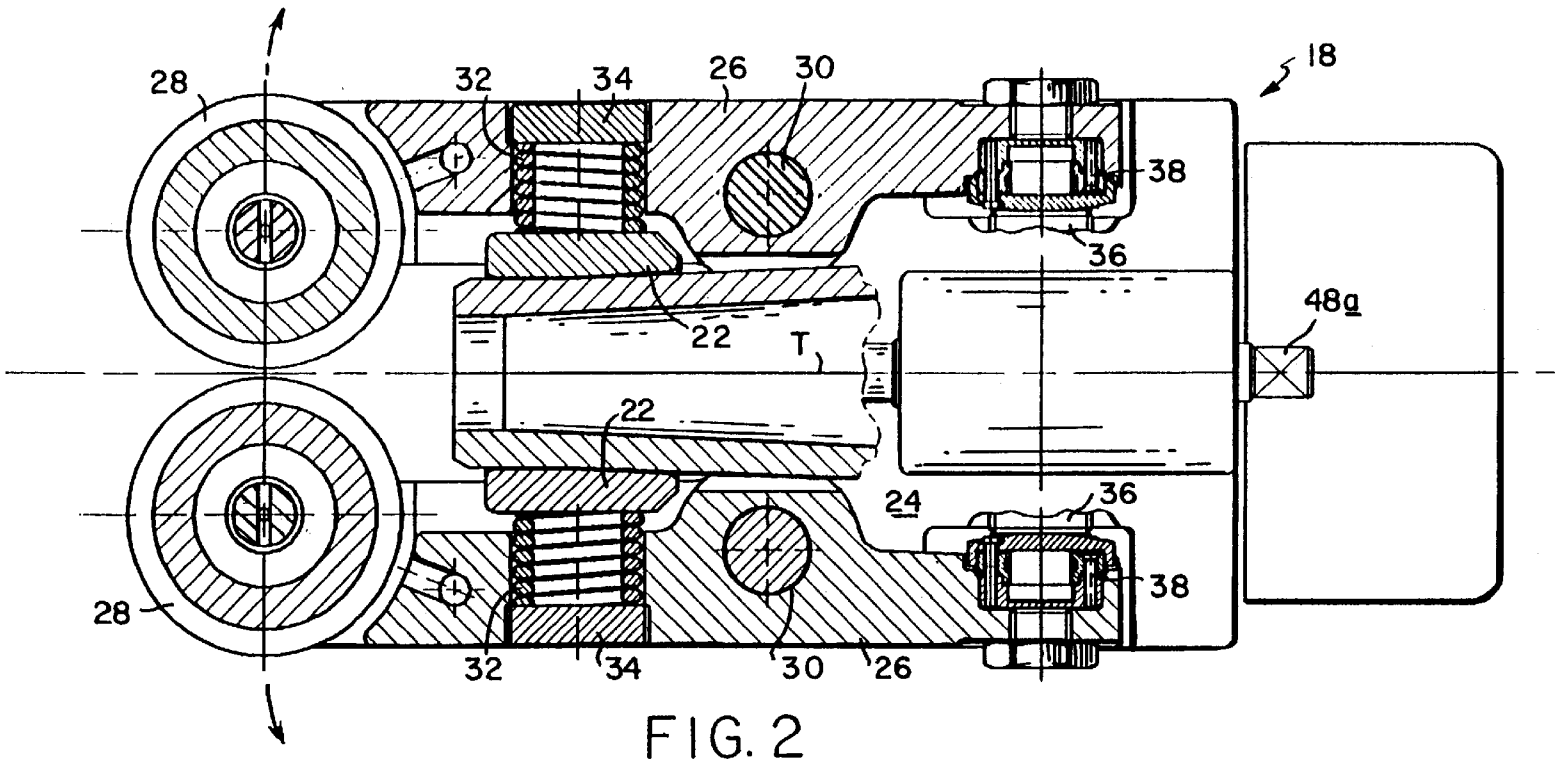
FIG. 2 is a partially sectioned top plan view of a roller guide assembly in accordance with the present invention.
Figure 3:
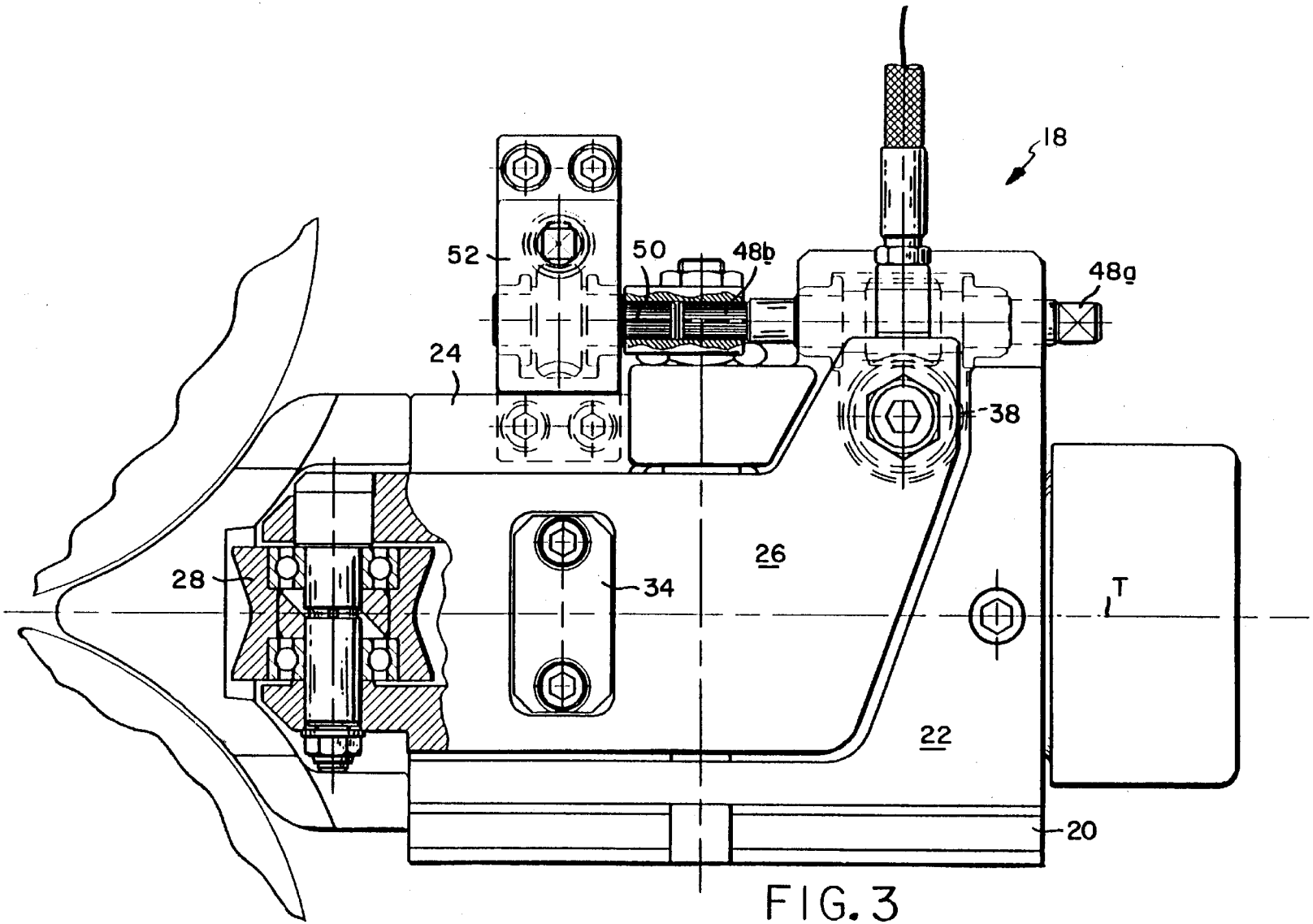
FIG. 3 is a partially sectioned side view of the roller guide assembly.
Figure 4:
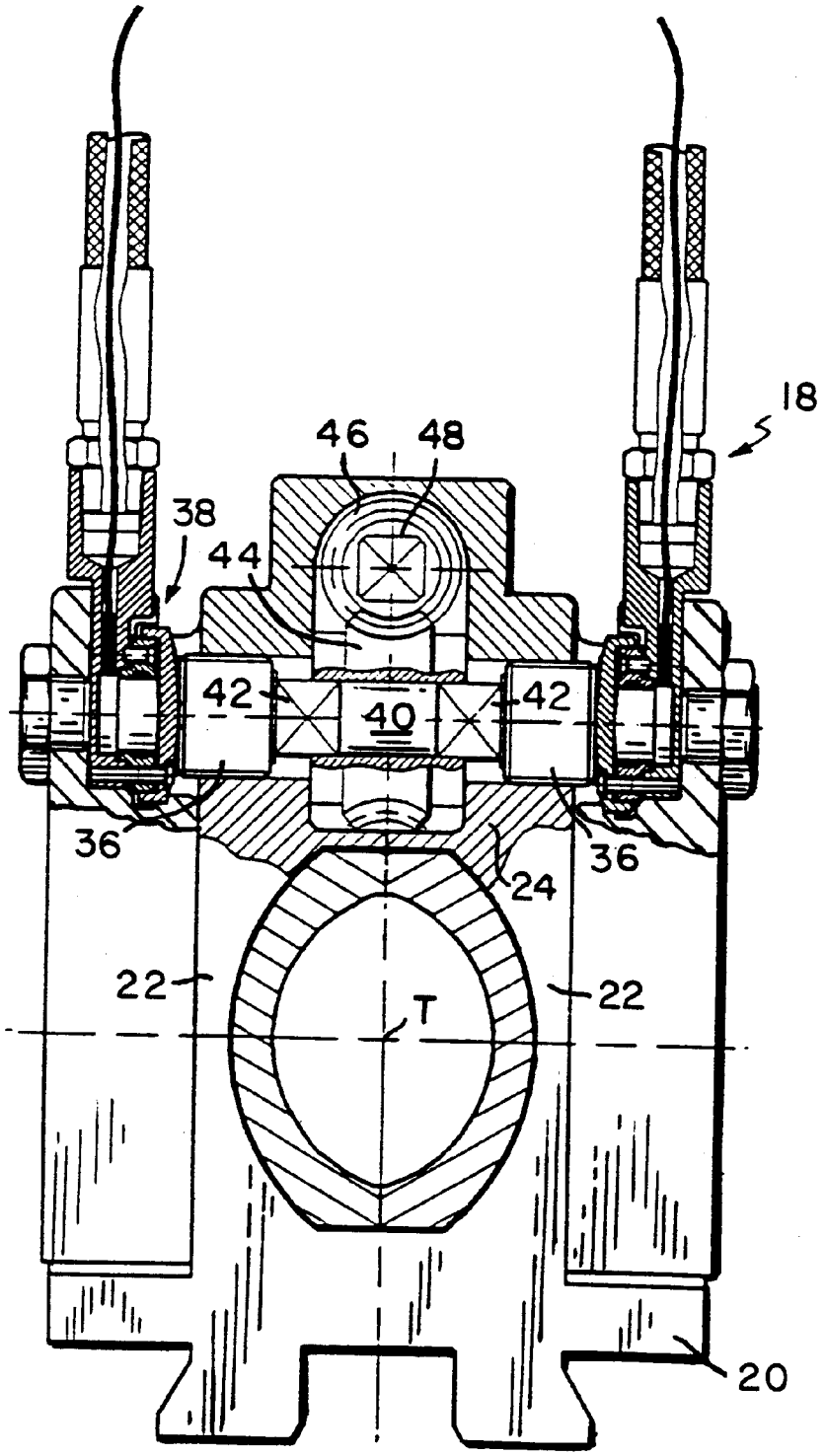
FIG. 4 is a partially sectioned end view of the roller guide assembly as viewed from right to left in FIG. 3.

Referring initially to FIGS. 2–4, a roller guide assembly in accordance with the present invention is generally indicated at 18. The guide assembly includes a rigid housing structure commonly referred to as a "guide box" having a base 20, with integral laterally spaced side members 22, and a nose piece 24. A pair of roller holders 26 extends lengthwise of the housing structure on opposite sides of the intended direction of travel "T" of the workpiece, in this case an oval process section received from the oval pass 10 for delivery into the next successive round pass 12.

Figure 1:
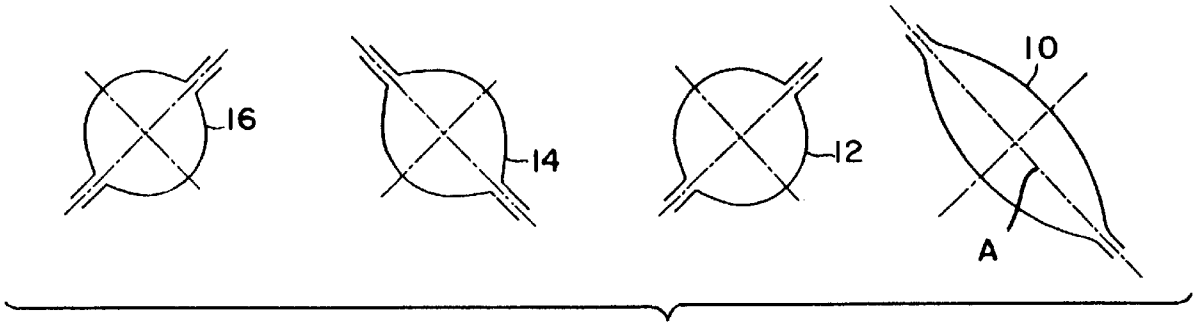
FIG. 1 PRIOR ART
FIG. 1 is a diagrammatic illustration of a typical pass progression in a reducing-sizing process.

Guide rollers 28 are rotatably carried at the forward ends of the roller holders 26. The guide rollers define a gap therebetween, and are configured to engage and guide the oval process section so that it is correctly presented to the round pass, with the elongate axis "A" of the oval (shown in FIG. 1) normal to the axes of the rolls of the round pass 12.

The housing structure further includes vertical pivots 30 on which the roller holders 26 are mounted for movement about axes extending generally parallel to the rotational axes of the guide rollers 28.

Compression springs 32 are located in bores in the roller holders 26. The springs abut the side members 22 of the housing structure and are captured in their respective bores by cover plates 34 secured to the roller holders. The springs 32 are loaded in compression and as such, exert yieldable forces "F" (see Figure Sa) on the roller holders urging the roller holders to rotate in opposite directions about the pivots 30, as depicted diagrammatically by the arrows in FIG. 2.

The spring-induced rotation of the roller holders is resisted by stops comprising adjusting screws 36 positioned to be contacted by load sensitive sensors 38 carried on rearward extensions of the roller holders.

As can be seen in FIG. 4, the adjusting screws 36 are threaded into right and left hand threaded sections of the side members 22 of the housing structure. The square ends 42 of the adjusting screws slide axially within the square bore 40 of a gear 44 meshing with a gear 46 on a drive shaft 48 having two drive points 48*a*, 48*b*. The drive point 48*a* is for manual adjustment, generally used for off-line setting of the guide. The other point 48*b* mates with the output shaft 50 of a 90° gear box 52 powered either manually, or by a motor (not shown) which may be controlled remotely.

Figure 5A:
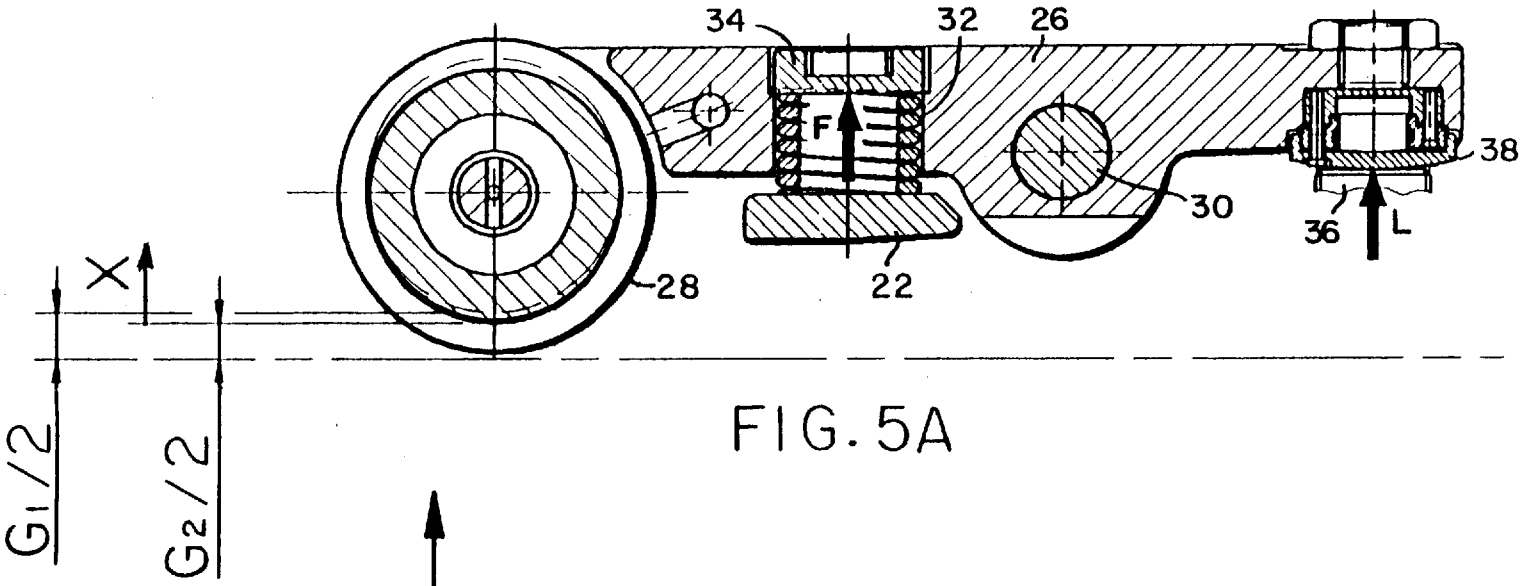
FIG. 5*a* diagrammatically illustrates the forces acting on one of the guide arms.

As shown in FIG. 5*a*, the force F exerted by the spring 32 is opposed by force "L", with the sensors 38 serving to measure the magnitude of the force F.

Various modes of operation are possible after initial set-up.

1. Position Control Mode

Figure 5B:
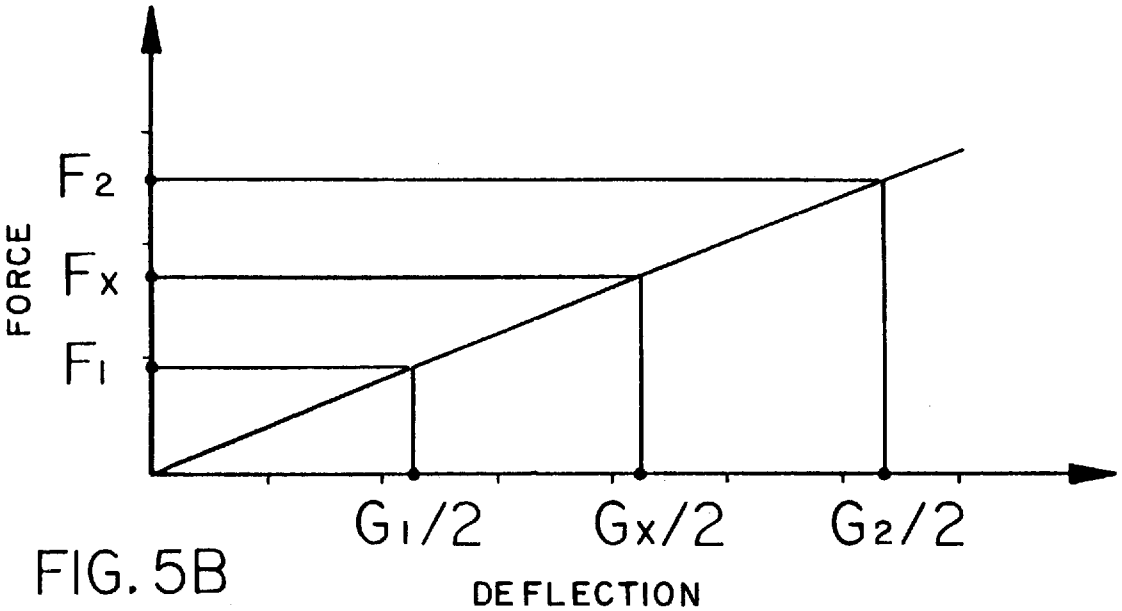
FIG. 5*b* is a graph depicting the relationship between the measured force acting on each roller holder and its deflection from an initial reference setting.

FIG. 5*b* shows that when the guide is adjusted to its desired setting "$G_1$", the output of each sensor is recorded as "$F_1$". The guide is then deflected to a different known setting "$G_2$" by means of gauge bar or other means of controlled deflection (not shown), and the new sensor output "$F_2$" recorded. This can be repeated for several other setting if desired for improved accuracy. However, two points are usually sufficient to describe the relationship between guide setting and sensor output which is generally linear.

Knowing the relationship between guide setting and sensor output enables the guide to be adjusted to a predetermined sensor setting "$F_x$" which corresponds to the desired parting between the guide roller "$G_x$". Hence the guide can be accurately positioned without being removed from the mill.

When changes are required to the process oval, the guide can be remotely adjusted in order to re-position the guide rollers to the desired oval height, leading to an increase in the free sizing range capability of the reducing and sizing operation.

2. Sensor Output Control Mode

For this mode it is assumed that the spring element used within the guide has negligible variation when the guide parting is adjusted by small amounts.

The guide is set as detailed above and once the rollers are at the correct setting for the section being rolled, the output of the sensor (or sensors) is recorded.

The guide is then installed on the mill and when the stock enters the guide, the sensor output is again monitored and recorded. If the mill is set correctly, the sensor output during rolling should be very close to that of the initial setup. If not, then the mill roll gap can be adjusted to change the height of the leading oval until this condition is met.

When adjustments are required to the oval pass, the guide can be adjusted using the remotely operable adjustment apparatus as detailed above, such that the parting between the guide rollers is approximately the magnitude required by the new set up. When the first bar of the new size enters the guide, the sensor output is monitored and compared with the initial setup value. If necessary the guide can be adjusted accordingly until the correct output is achieved. Ideally this is undertaken in automatic closed loop control, but may also be controlled manually.

This mode of operation ensures that the guides are always set to match the dimensions of the process oval. When the process oval is changed, the guide can be made to adapt accordingly, therefore leading to an increase in the free sizing range capability of the reducing and sizing operation.

This mode also enable the guide to be set to eliminate over-loading or oscillating stock as well as enabling the guide to be remotely adjusted in accordance with temperature and yield strength changes associated with different grade products.

All of the above concepts can be applied to the rolling of shapes and flat product as well as rounds.

In light of the foregoing, it will now be appreciated by those skilled in the art that various changes and modifications may be made to the embodiment herein chosen for purposes of disclosure without departing from the spirit and scope of the invention as defined by the appended claims. For example, although compression springs 32 have been disclosed, other force exerting components could be substituted, including disc springs, fluid actuated devices, elastomers, etc. The sensors may be other than load sensitive, including for example those sensitive to strain, pressure deflection, etc. Also, although two sensors are shown, one for each roller holder, an acceptable alternative would be to employ only one sensor on one of the roller holders.

I claim:

1. A roller guide assembly for guiding a workpiece into a roll pass of a rolling mill, said guide assembly comprising:

a rigid housing structure;

a pair of roller holders extending lengthwise of the housing structure on opposite sides of the intended direction of travel of the workpiece;

pivot means for mounting said roller holders on said housing structure for pivotal movement about parallel first axes, said pivot means being positioned between forward and rearward sections of said roller holders;

guide rollers carried on the forward sections of said roller holders for rotation about second axes parallel to said first axes, said guide rollers defining a gap therebetween and being configured to engage and guide the workpiece into the roll pass of the rolling mill;

adjustment means acting on the rearward sections of said roller holders for pivoting said roller holders in opposite directions about said first axes to thereby adjust the size of said gap;

force exerting means for exerting yieldable forces urging the forward sections of said roller holders apart while urging the rearward sections of said roller holders into contact with said adjustment means, the magnitude of said yieldable forces varying in a generally linear relationship with respect to changes in the size of the gap defined by said guide rollers; and force sensing means associated with said adjustment means for generating output signals representative of the magnitude of said yieldable forces.

2. The roller guide assembly of claim 1 wherein said force sensing means comprises load sensitive sensors interposed between both of said roller holders and said adjustment means.

3. The roller guide assembly of claim 1 wherein said force exerting means comprises resilient springs interposed between said roller holders and adjacent sides of said housing structure.

4. The roller guide assembly of claim 1 wherein said adjustment means is remotely operable.

* * * * *